US008684369B1

(12) United States Patent
Petell et al.

(10) Patent No.: US 8,684,369 B1
(45) Date of Patent: Apr. 1, 2014

(54) BALL PICK

(71) Applicants: John James Petell, Riverside, RI (US); Nicolas Alan Perna, Fairfax, VA (US)

(72) Inventors: John James Petell, Riverside, RI (US); Nicolas Alan Perna, Fairfax, VA (US)

(73) Assignee: Harmony Sports Inc., Riverside, RI (US)

( * ) Notice: Subject to any disclaimer, the term of this patent is extended or adjusted under 35 U.S.C. 154(b) by 181 days.

(21) Appl. No.: 13/573,550

(22) Filed: Sep. 24, 2012

(51) Int. Cl.
*A63C 17/14* (2006.01)
*A63C 17/24* (2006.01)

(52) U.S. Cl.
USPC ..... 280/11.209; 280/11.226; 280/11.232

(58) Field of Classification Search
USPC ..... 280/11.19, 11.221, 11.222, 11.226, 280/11.227, 11.27, 11.232, 841, 11.209
See application file for complete search history.

(56) References Cited

U.S. PATENT DOCUMENTS

| | | | | | |
|---|---|---|---|---|---|
| 894,501 | A | * | 7/1908 | Hohenadel | 280/11.209 |
| 899,963 | A | * | 9/1908 | Ferguson | 280/11.206 |
| 1,868,548 | A | * | 7/1932 | Turner | 280/11.209 |
| 2,048,916 | A | * | 7/1936 | Bentzlin | 280/11.221 |
| 2,570,349 | A | * | 10/1951 | Kardhordo | 280/11.222 |
| 2,595,751 | A | * | 5/1952 | Balstad | 280/11.28 |
| 2,826,422 | A | * | 3/1958 | Snyder | 280/11.209 |
| 3,693,988 | A | * | 9/1972 | Steinhiser | 280/11.223 |
| 3,843,146 | A | * | 10/1974 | Hiraki | 280/11.209 |
| 3,936,061 | A | * | 2/1976 | Wada | 280/11.226 |
| 4,034,995 | A | * | 7/1977 | Forward et al. | 280/843 |
| 4,090,283 | A | * | 5/1978 | Woolley | 29/894 |
| 4,273,345 | A | * | 6/1981 | Ben-Dor et al. | 280/11.208 |
| 4,844,492 | A | * | 7/1989 | Ludwig | 280/11.227 |
| 5,052,701 | A | * | 10/1991 | Olson | 280/11.208 |
| 5,280,931 | A | * | 1/1994 | Horton | 280/11.206 |
| 5,308,093 | A | * | 5/1994 | Walin | 280/11.207 |
| D364,437 | S | * | 11/1995 | Pratt | D21/776 |
| 5,472,218 | A | * | 12/1995 | Pratt | 280/11.209 |
| 5,590,890 | A | * | 1/1997 | Rosso et al. | 280/11.226 |
| RE35,493 | E | * | 4/1997 | Horton | 280/11.206 |
| 5,738,360 | A | * | 4/1998 | Petell et al. | 280/11.232 |
| 6,113,112 | A | * | 9/2000 | Kubelka | 280/11.231 |
| 6,443,463 | B1 | * | 9/2002 | Kubelka | 280/11.19 |
| 8,256,776 | B2 | * | 9/2012 | Petell et al. | 280/11.232 |
| 2004/0021278 | A1 | * | 2/2004 | Lyden | 280/11.31 |
| 2006/0038361 | A1 | * | 2/2006 | Sano | 280/11.221 |

* cited by examiner

*Primary Examiner* — J. Allen Shriver, II
*Assistant Examiner* — Bridget Avery

(57) ABSTRACT

A specially formed ball shaped disc 40 to 50 mm in diameter to be utilized on the PIC® inline skate, U.S. Pat. No. 5,738,360, to allow for extreme jumps, spins, and footwork moves in the sport of inline figure skating. The ball pick disc is made of molded rubber or synthetic material. The purpose of the ball pick is to provide extreme deep edges for enhanced spins, jumps, and footwork common in the sport of inline figure skating while protecting the skate frame from scraping. The ball shape is slotted to fit around the frame thus protecting the frame from scraping and allows the skater to achieve extremely deep edges. The ball shape provides 180 degrees of surface allowing the skater unlimited toe-in angles. The configuration of the disc allows the ball pick to be reversed to extend wear.

3 Claims, 8 Drawing Sheets

BALL PICK

CROSS REFERENCE

A provisional application was filed Nov. 30, 2011. U.S.PTO No. 61/629,880.

FIELD OF INVENTION

This invention relates to the toe pick disc used on the PIC® inline skate, a specially designed inline skate which is the basis of the sport of inline figure skating.

BACKGROUND OF THE INVENTION

At the present time inline figure skaters practice their sport utilizing an inline PIC® skate which employs a 45 mm×29 mm cylindrical pick as seen in U.S. Pat. No. 8,256,776 B2. As with ice figure skates, the pick serves as an end point by which skaters execute a variety of footwork maneuvers including spins and take-offs in the execution of jumps. While an ice blade has a serrated flat edge designed to penetrate ice, the cylindrical pick disc of the inline figure skate is blunt.

Reports from inline figure skaters determined that a specially configured ball shaped disc with an outer surface area which engages the skating surface at any angle from 0 to 180 degrees while protecting the skating frame would greatly enhance performance by providing a solid contact point for the optimal execution of jumps, spins, and footwork maneuvers.

SUMMARY OF INVENTION

In accordance with the present invention, a ball shaped pick disc for inline figure skates provides the skater with the means to execute a wide variety of maneuvers in the sport of inline figure skating.

In general, the invention features a ball shaped pick disc of molded rubber or synthetic material and is designed to fit the PIC® inline skate referenced in U.S. Pat. No. 5,738,360.

The invention is a 40 to 50 mm ball disc, 45 mm is optimal, with slots to fit and protect the frame. The shape allows for 180 degrees of exposure to the skating surface enabling skaters to execute a wide range of skating maneuvers, jumps, spins, and especially deep edges required for certain maneuvers while protecting the skate frame. In a variation, the ball pick disc may exhibit other configurations to enhance grip and rebound.

BRIEF DESCRIPTION OF DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis being placed on the principles of the invention.

DESCRIPTION OF THE EMBODIMENTS OF THE INVENTION

Figure 1:
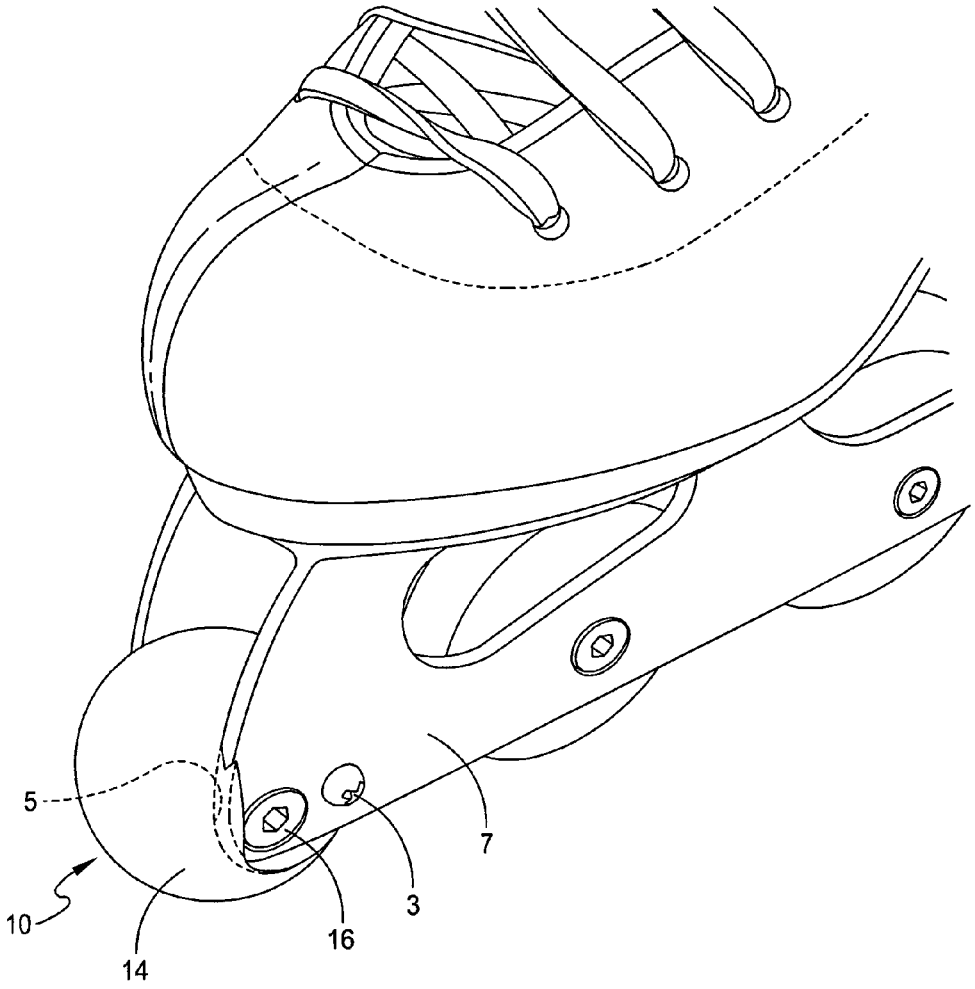
FIG. 1 illustrates use of the ball pick disc in a ¾ view.

Referring to FIG. 1 shows the ball pick 10 attached to the frame 7. The ball pick disc has slots 5 to encompass the frames 7 outer edges and is held secure by machine screws 3 and a mounting bolt 16: the ball pick disc 14 surface exposes 180 degrees of contact area. The disc 10 has a diameter of between 40 and 50 mm: the ideal being 45 mm. The outer surface 14 provides protection of the frame which is enveloped by 2 slots on opposing sides 5 which allows for maximum contact for toe-ins, deep edges, and push-offs necessary for spins jumps, and footwork maneuvers.

Figure 2:
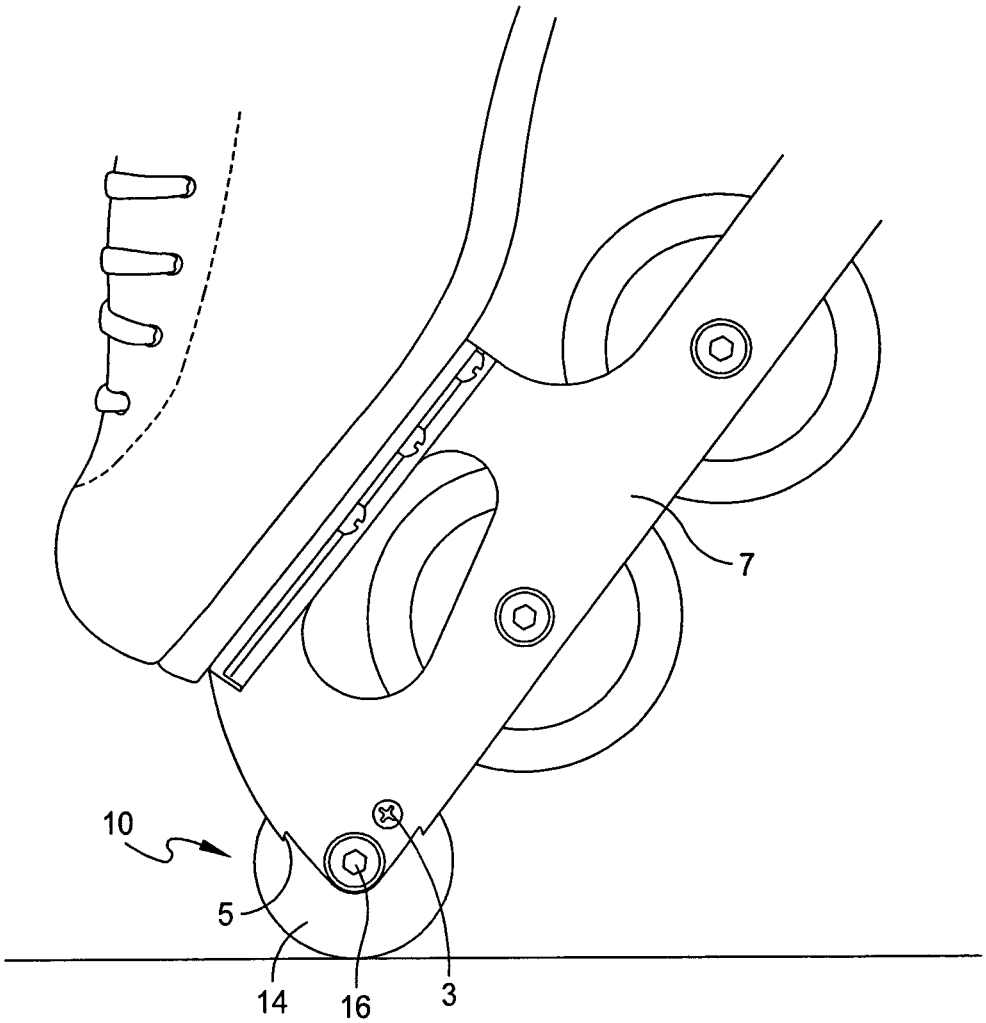
FIG. 2 illustrates use of the ball pick disc in a side view.

Referring to FIG. 2 is a side view of the ball pick disc 10 toe-in.

Figure 3:
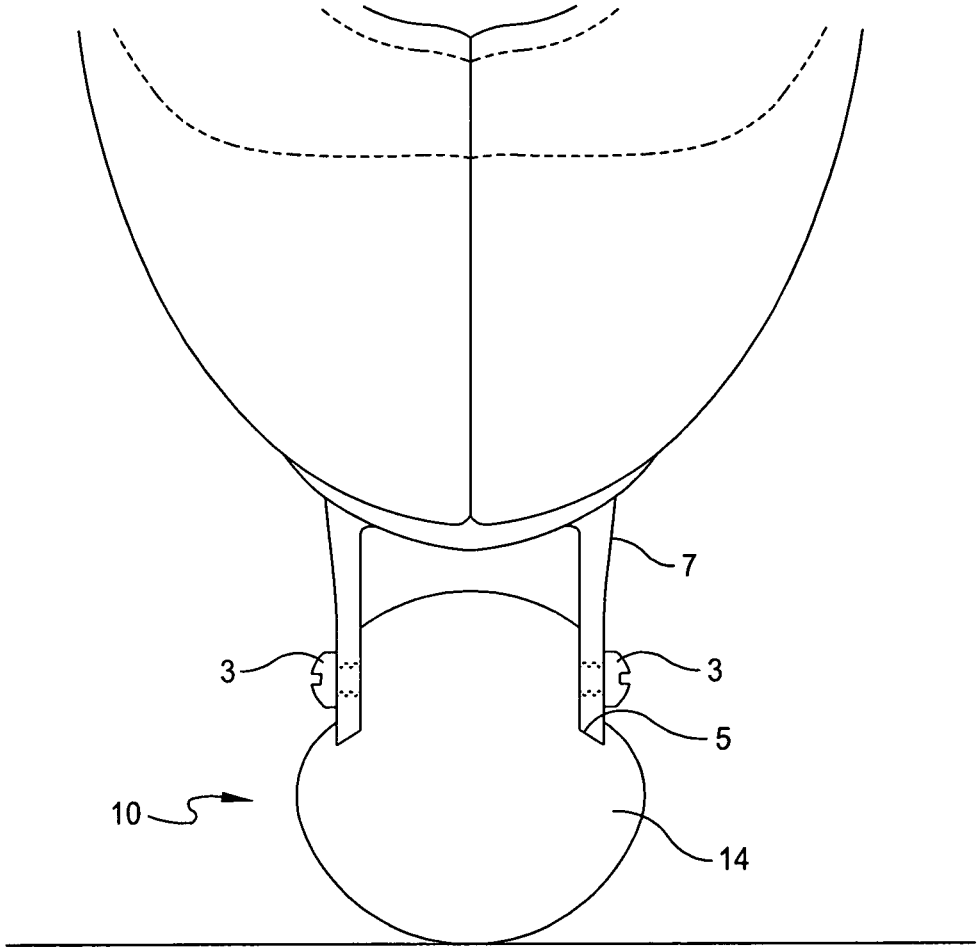
FIG. 3 illustrates use of the ball pick disc in a front view.

Referring to FIG. 3 is a front view of ball pick disc 10.

Figure 4:
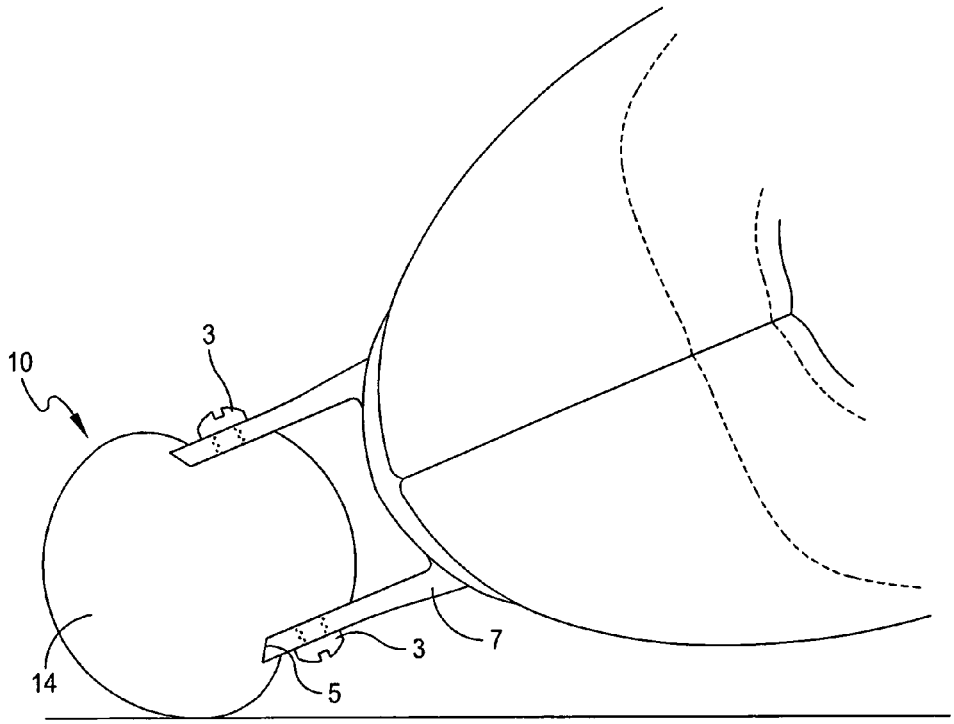
FIG. 4 illustrates use of the ball pick disc in an extreme front view.

Referring to FIG. 4 is a side view of the ball pick disc 10 and illustrates a deep angle.

Figure 5:
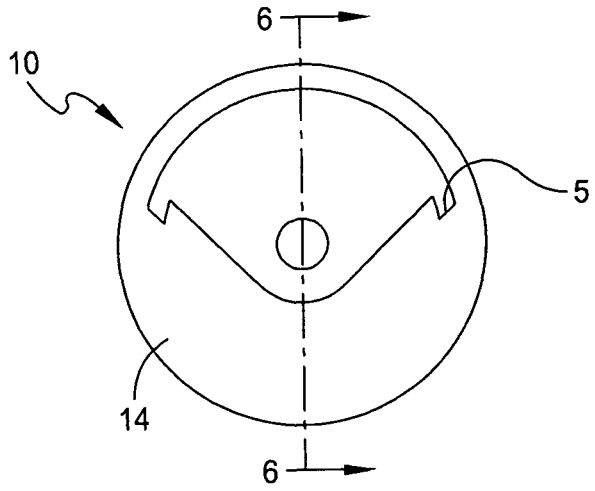
FIG. 5 is a side view of the ball pick disc.

Referring to FIG. 5 is a side view of the ball pick disc 10.

Figure 6:
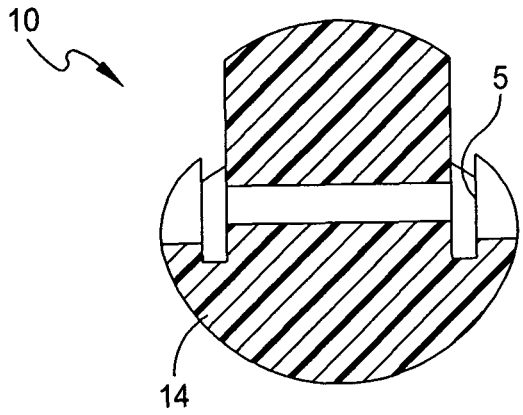
FIG. 6 is a cross section view of the ball pick disc.

Referring to FIG. 6 is a cross-section from FIG. 5 location 6 of ball pick disc 10.

Figure 7:
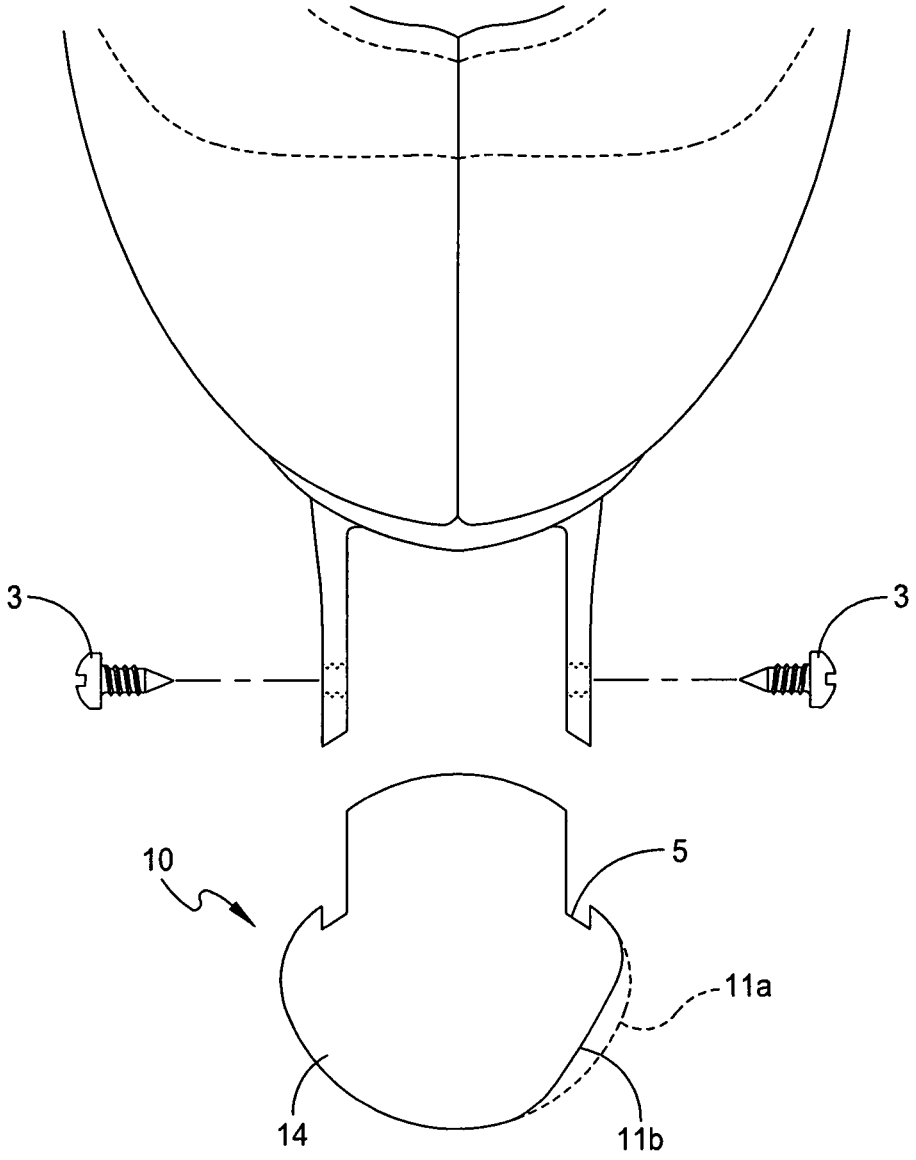
FIG. 7 is a top view with ball pick disc detached.

Referring to FIG. 7 is a top view of the ball pick disc 10 detached. 11*a* and 11*b* illustrate surface 14 wear due to abrasion.

Figure 8:
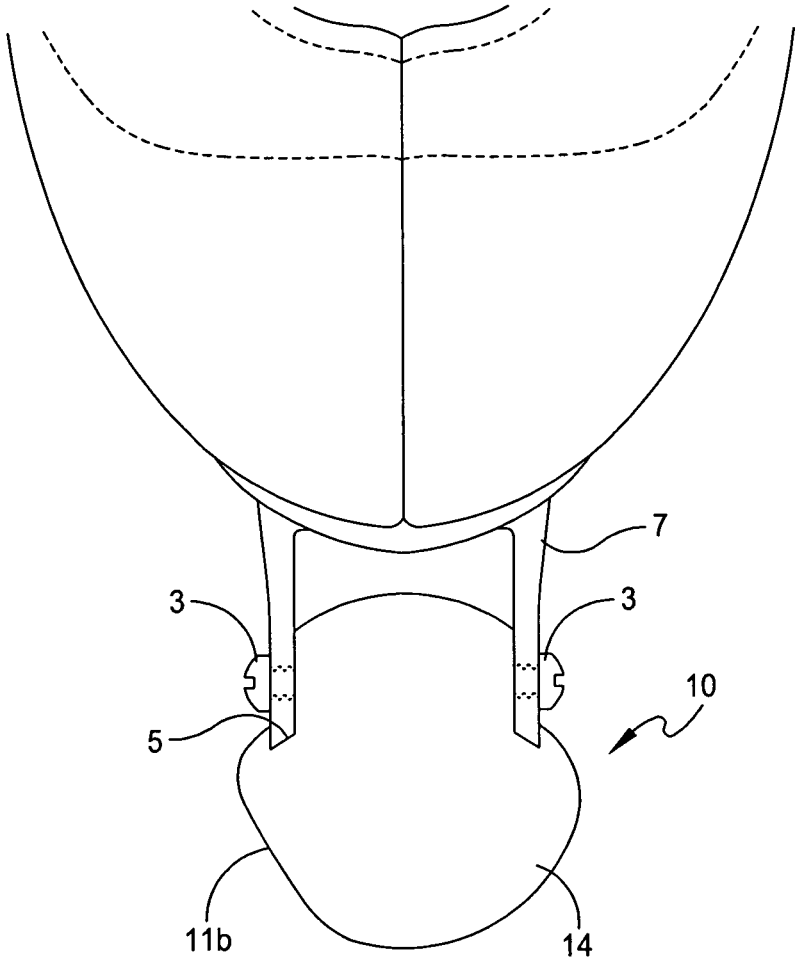
FIG. 8 is a top view with the ball pick disc attached.

Referring to FIG. 8 is a top view of the ball pick disc 10 attached and mounted on the opposite side shown in FIG. 7 as seen with 11*b*.

Figure 9:
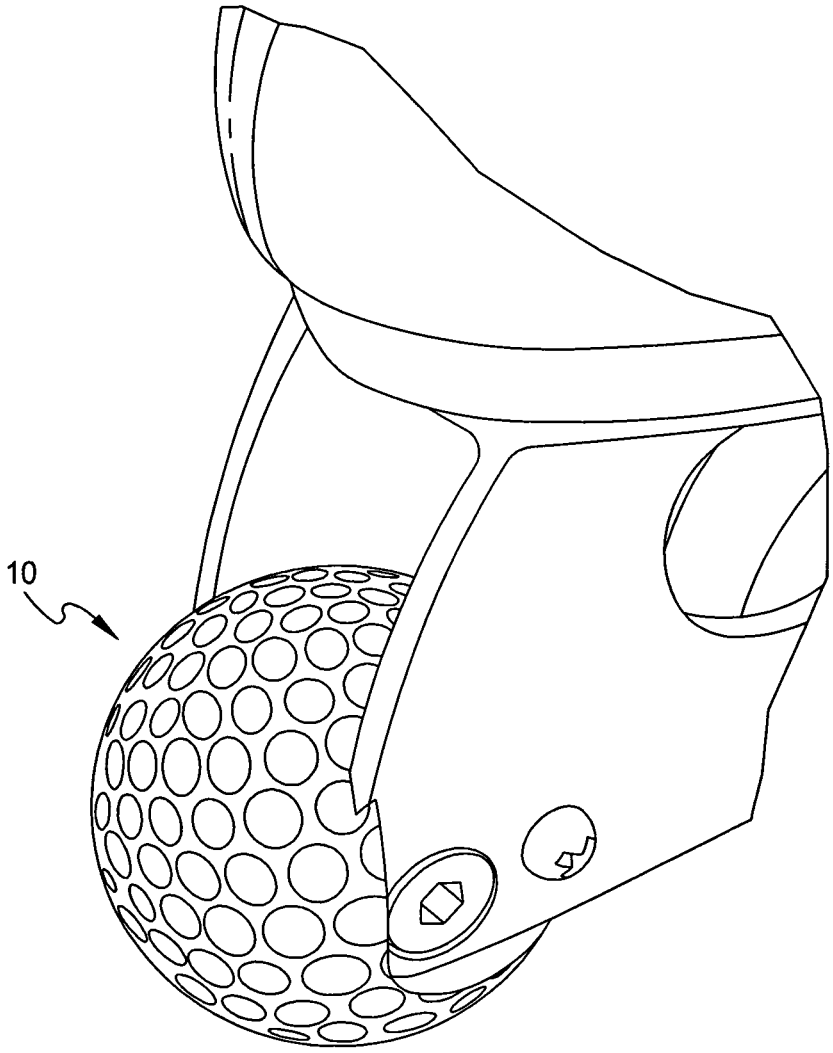
FIG. 9 is a ¾ view of an alternate embodiment of the ball pick disc.

Referring to FIG. 9 is a ¾ view of an alternative embodiment of the ball pick disc 10.

We claim:

1. A ball pick sphere mounted on an inline skate frame having forward outer edges, comprising: the ball pick sphere being constructed of rubber or synthetic material that is 40 to 50 mm in diameter and being secured in a fixed position by set screws with a center mounting hole of the ball pick sphere at the toe of the frame; slots to encompass the frame outer edges, wherein the sphere extends laterally beyond the forward outer edges of the frame exposing the ball pick sphere surface 180 degrees longitudinally and laterally, allowing for maximum available contact surface thus enabling the skater to execute a wide range of skating maneuvers and achieve extreme angles required for spins, jumps, and footwork common in figure skating while protecting the frame.

2. The ball pick sphere of claim 1, wherein when the exposed surface of the ball pick sphere becomes worn, the sphere may be removed from the frame, turned over and remounted to the frame, thus affording double life to each ball pick sphere.

3. The ball pick sphere of claim 1, further comprising the ball pick sphere having various surface configurations to enhance the properties of grip and rebound.

* * * * *